United States Patent [19]

Smith

[11] 4,253,312

[45] Mar. 3, 1981

[54] APPARATUS FOR THE RECOVERY OF USEFUL HEAT FROM REFRIGERATION GASES

[76] Inventor: Derrick A. Smith, 1180 S. Seabreeze Blvd., Ft. Lauderdale, Fla. 33316

[21] Appl. No.: 70,330

[22] Filed: Aug. 27, 1979

[51] Int. Cl.[3] ..... F25B 27/02; F25B 13/00

[52] U.S. Cl. ..... 62/238 E; 62/324 D

[58] Field of Search ..... 62/238 E, 324 D, 79

[56] References Cited

U.S. PATENT DOCUMENTS

| | | | |
|---|---|---|---|
| 1,874,803 | 8/1932 | Reed | 62/238 E |
| 3,916,638 | 11/1975 | Schmidt | 62/238 E |
| 3,926,008 | 12/1975 | Webber | 62/238 E |
| 4,165,037 | 8/1979 | McCarson | 62/238 E |

*Primary Examiner*—Lloyd L. King

[57] ABSTRACT

An improvement is provided in a heat extraction device provided in association with a heat exchanger system including a condenser, an evaporator, means for circulating a compressed liquid heat exchange fluid between the condenser and the evaporator and a heat exchanger disposed in the system to heat external water. The improvement resides in the use of conical heat exchanger coils in order to maximize heat exchange, and the provision of control means for sensing pressure, temperature and state of the heat exchange fluid and which regulates the entire operation safely and economically.

5 Claims, 2 Drawing Figures

APPARATUS FOR THE RECOVERY OF USEFUL HEAT FROM REFRIGERATION GASES

Figure 1:
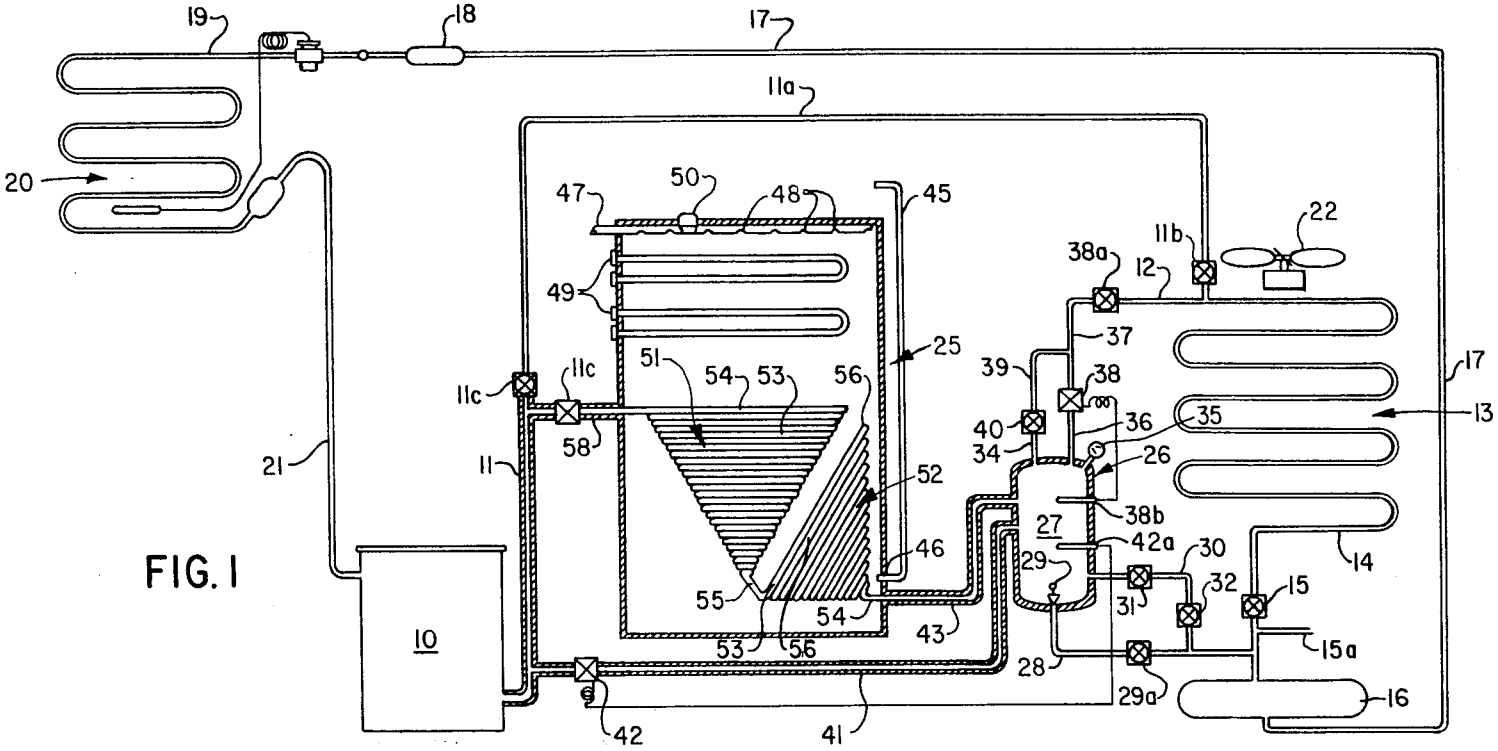

This invention relates to improvements in an apparatus for the recovery of useful heat from devices which transfer heat by processes known as air conditioning and refrigeration.

It is common in air conditioning, refrigeration and cooling equipment that the temperature of a specified area be reduced by the removal of heat to some other area where its effect is of no concern, e.g., in the open air. The present practice discards not only the energy in the heat collected from the place being cooled, but it also puts to waste the part of the applied electrical energy which spontaneously converts to heat as the motor turns.

Proposals have been made in the past to make use of this heat, (see for example, U.S. Pat. Nos. 2,751,761 issued June 26, 1956 to Borgerd, 3,017,162 issued Jan. 1, 1962 to Haines et al, 3,308,877 issued Mar. 14, 1967 to Gerteis and 3,916,638 issued Nov. 4, 1975 to Schmidt.) However, these proposals have not been too successful because of the fact that in trying to capture the energy being discarded serious temperatures—pressure irregularities develop in different parts of the system.

Accordingly, it is an object of a broad aspect of this invention to provide an improved apparatus for the recovery of useful heat from air conditioning and/or refrigeration equipment.

The present invention in one of its broad aspects is based on the concept of the use of a double (series connected) conical heat exchanger (scavenger) disposed in water in a tank and a master controller which is sensitive to temperature/pressure and the state of the refrigerant after it leaves the scavenger. The heat exchanger and the master control will also normalize the irregularities in the system. A perforated arrangement of the outlet pipe from the tank will facilitate regular outlet water temperatures.

By a broad aspect of this invention an improvement is provided in a heat exchanger system including a condenser, an evaporator, means for circulating a compressed heat exchange fluid between the condenser and the evaporator, and a heat extraction system connected in series with the heat exchanger system for heating an external supply of water, the improvement wherein the heat exchange system comprises a heat exchanger unit and a master control unit; the master control unit comprising a tank having inlet means for heat exchange fluid, control means for automatically withdrawing gaseous heat exchange fluid for admission to said condenser, control means for selectively recycling the liquid heat exchange fluid, to a receiving tank, and outlet means for controllably withdrawing mixed liquid gaseous heat exchange fluid to said receiving tank; the heat exchanger comprising a main tank, cold water inlet means to the bottom of the tank, hot water outlet means from the top of the tank, and a pair of series connected conical heat exchanger coils disposed in the lower half of the main tank and being connected between a compressed hot heat exchange fluid inlet near the mid portion of the main tank and a cooled heat exchanger fluid outlet near the bottom of the tank, the conical coils thus being connected between the compressor and the master control unit.

By one variant thereof, a first such heat exchanger is connected to the liquid heat exchange fluid inlet so that it is disposed on its side, with the liquid heat exchange fluid conducting coils being arranged angularly with respect to the tank, and wherein the other said conical heat exchanger is series connected to the first heat exchanger so that it is in the form of an inverted cone with its liquid heat exchanger fluid conducting coils being arranged horizontally with respect to the tank.

By another variant, the master control cylinder comprises: inlet means for refrigerant; primary gas outlet means from, the upper reaches of the master control cylinder, flow of gas through the primary gas outlet means being controlled by a pressure controlled solonoid valve; emergency gas outlet means from the upper reaches of the master control cylinder, flow of gas from the emergency gas outlet means being controlled by a rupturable valve, which is adapted to rupture at a designated pressure higher than that which actuated the solenoid valve of the primary gas outlet means; liquid outlet means from the lower reaches of the master control cylinder, flow of liquid through the liquid outlet means being controlled by a float valve; and emergency by-pass fluid outlet means near the lower reaches of the master control cylinder, flow of fluid through the fluid outlet means being controlled by a solenoid valve actuated by a combined liquid/gas pressure of which the liquid is insufficient to activate the float valve and the gas is insufficient to activate the primary gas outlet solenoid valve.

By another variant, the hot water outlet means from the tank comprises a perforated tube extending across the upper extent of the tank.

By a variation of this invention, the heat exchanger includes auxiliary electric heaters disposed in the upper region of the tank, and a thermostat for automatically operating such electrical heaters.

Figure 2:
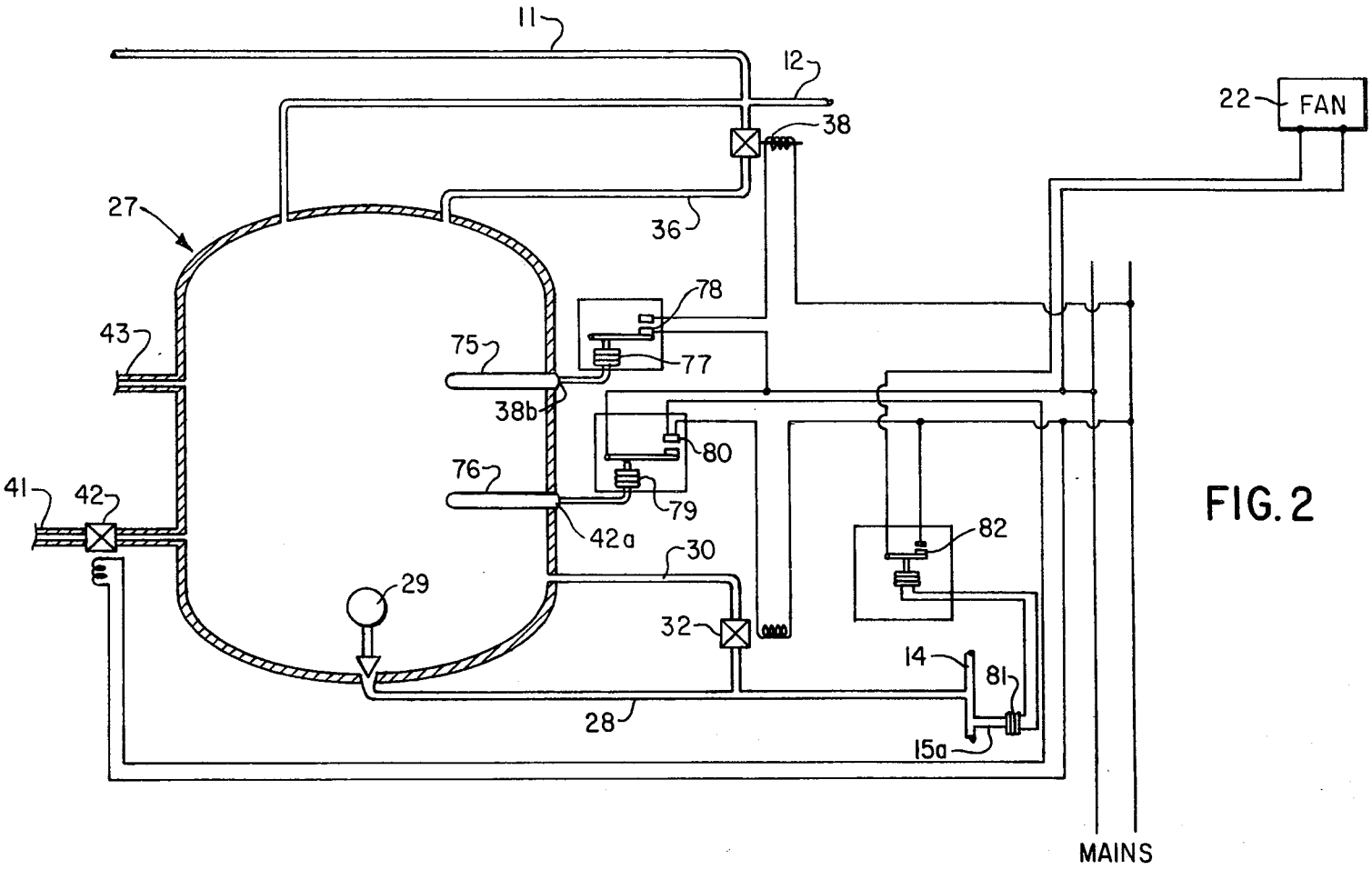

In the accompanying drawings,

FIG. 1 is a schematic flow drawing of the heat scavanger of a broad aspect of this invention; and FIG. 2 is a schematic flow drawing of the circuiting electrical means and pressure sensing to provide automatic operation of the heat scavanger of a broad aspect of this invention.

In general terms, the present invention as shown in the drawings conmprises two sets of coils placed towards the bottom end of the fluid tank. These coils will permit the superheat in the refrigerant to be transferred to the fluid. At the top of the tank is the fluid outlet which will now have the heat picked up from the refrigerant.

The inner portion of the outlet line is perforated and evenly distributed so as to get an even pickup of fluid right across the tank; hence the temperature at the outlet (exterior of the tank) would be regular. A mixing and sensing tank ensures that the temperature and pressure of the refrigerant are properly regulated before entering the liquid receiver. This will enable the system to function normally although the superheat is being removed in the heat exchanger.

In more specific terms, the drawings in FIG. 1 show how the heat scavenger is superposed on the standard air conditioning/refrigeration system. Gaseous refrigerant is compressed in compressor 10 and is fed, in the form of a hot fluid along heat insulated line 11 and main line **11*a* through manual shut-off valves 11*b* to inlet line 12 of a condenser 13. Outlet refrigerant flow from condenser 13 is via outline 14 and check valve 15 to a liquid receiving tank 16. The liquid refrigerant is then fed via line 17 through conventional filtering arrangements 18** to the inlet line 19 of an evaporator 20. The cooled expanded refrigerant gases so formed pass through suction line 21 back to compressor 10. Generally, the hot fluid is cooled in condenser 13, and the heat extracted is dissipated by fan 22. Line 14 includes a fan control port 15*a*. If the sensor (to be described with reference to FIG. 2) senses cooled liquid, then fan 22 is rendered inoperative, thereby saving energy.

In order to enable the capture of the useful heat according to aspects of this invention, a heat scavenger system is provided including a heat exchanger unit 25 and a master control cylinder 26. Master control cylinder 26 comprises a pressure tank 27 provided with a plurality of valved inlet and outlet lines. The upper portion of tank 27 is provided with a main refrigerant inlet line 43, where cooled fluid refrigerant, i.e. either gas or liquid of gas/liquid is admitted. A primary gas outlet line 37 leads via a primary gas pressure solenoid 38 and a control valve 38*a* to line 12. In order to provide fail safe operation in the event of jamming of solenoid valve 38, emergency gas outlet line 39 is provided which leads via rupturable valve 40 to line 36. Valve 40 is designed to rupture at a safe pressure which is higher than the pressure needed to activate solonoid valve 38. Solonoid valve 38 is controlled by means 38*b* to be described in greater detail with reference to FIG. 2.

The lower portion of tank 27 includes a liquid refrigerant outlet line 28 operated by float valve 29 and through valve 29*a* to line 33 leading to liquid receiving tank 16. Line 28 enables refrigerant liquid to be automatically drawn off into liquid receiving tank 16.

In order to enable proper flow of refrigerant through the system when the basic refrigerant system has superposed thereon the heat scavenger system, it is necessary to add further refrigerant. Because the volume of the system has been increased neither the gas solonoid valve 38 not the liquid float valve is operative. Because of this, fluid outlet line 30, activated by fluid pressure solenoid valve 32 and passing through manually controlled valve 31 enables the flow of fluid to line 14 to liquid receiving tank 16.

The upper portion of tank 27 is provided with a pressure gauge set up 35 and a valved inlet line 36 leading via manual valve 37 from main line 11 passed solenoid valve 38 to tank 27. Excess pressure is recycled via valved outlet line 34 provided with check valve 40 leading to line 36.

In the event that the pressure of refrigerant entering tank 27 via line 43 is too low and the gas is too cold, but yet not condensed enough to be liquid, additional hot refrigerant gas is led along insulated line 41 when solonoid valve 42 is opened, upon sensing this condition by sensor 42*a* (as will be described further with reference to FIG. 2).

Heat exchanger unit 25 comprises a main insulated tank 44 provided with a cold water inlet line 45 leading to an inlet port 46 near the bottom of tank 44 and hot water outlet line 47 leading from near the top of the tank 47, the portion of the outlet line 47 within the tank 47 being provided with bottom inlet perforations 48. Also disposed within tank 44 are auxiliary electric heaters 49, the tank being equipped with a thermostat 50 to control the operation of the auxiliary electric heaters 49.

The principal heating of the water in tank 44 is accomplished by a pair of interlinked conical heat exchangers 51, 52. Each heat exchanger 51, 52 is in the form of a hollow tube 53 wound around a cone to provide a conical series of tubes. Heat exchanger 51 is actually in the form of an inverted frustum, with the inlet thereto from insulated line 58 fed through insulated line 11 being to the larger diameter section tube 54 of the inverted frustum. The leading end of the smaller diameter section tube 55 of heat exchanger 51 leads to the leading end of the larger diameter section tube 56 of heat exchanger 52 disposed as a tilted cone. The outlet of the smaller diameter section tube 54 leads to outlet line 43 to control tank 27.

During the passage of the hot fluid refrigerant through conical heat exchangers 52, 52 much of the heat contained therein is transferred to the water. Consequently, the temperature of the outlet refrigerant liquid in line 43 is less than that of the inlet refrigerant in inlet line 58.

It will be observed that when the heat scavenger system is superposed on the conventional refrigeration system, line 11*a* is closed off by manual valves 11*c* and 11*b*.

As seen in FIG. 2 the master control tank 27 includes a pair of pressure sensing inverted fingers 75, 76. Within finger 75 is a pressure sensor 38*b* which, on sensing the pressure through pizzoelectric element or bellows 77 causes contacts 78 to close thereby completing an electrical circuit to open solenoid valve 38.

Within finger 76 is a pressure sensor 42*a*, which, on sensing the pressure through pizzoelectric element or bellows 79 causes contacts 80 to close, thereby completing the circuits to open solenoid valves 32 and 42.

In addition is shown fan control port 15*a* where pressure is detected by means of pizzoelectric element or bellows 81 to close contacts 82 to complete the circuit causing fan 22 to operate. Thus, if the pressure is too low, signifying cooled liquid refrigerant, then contacts 82 are opening, thus stopping the fan.

I claim:

1. In a heat exchanger system including a condenser, an evaporator, means for circulating a compressed heat exchange fluid between the condenser and the evaporator, and a heat extraction system connected in series with the heat exchanger system for heating an external supply of water, the improvement wherein the heat exchanger system comprises a heat exchanger unit and a master control unit; said master control unit comprising a tank having inlet means for heat exchanger fluid, control means for automatically withdrawing gaseous heat exchange fluid for admission to said condenser, control means for selectively recycling said liquid heat exchange fluid to a receiving tank, and outlet means for controllably withdrawing mixed liquid gaseous heat exchange fluid from said tank to said receiving tank; said heat exchanger comprising a main tank, col water inlet means to the bottom of the tank, hot water outlet means from the top of the tank, and a pair of series connected conical heat exchanger coils disposed in the lower half of the main tank and being connected between a compressed heat exchange fluid inlet near the mid-portion of the main tank and a cooled heat exchange fluid outlet mear the bottom of the tank, said conical heat exchanger coils, thus being connected between said compressor and said master controller.

2. The improved heat exchange system of claim 1, wherein a first said conical heat exchanger is connected to the liquid heat exchange fluid inlet so that it is disposed on its side, with the liquid heat exchange fluid conducting coils being arranged angularly with respect to the tank, and wherein the other said conical heat exchanger is series connected to the first heat exchanger so that it is in the form of an inverted cone with its liquid heat exchange fluid conducting coils being arranged horizontally with respect to the tank.

3. The improved heat exchange system of claim 1 wherein said master control cylinder comprises: inlet means for refrigerant; primary gas outlet means from the upper reaches of said master control cylinder, flow of gas through said primary gas outlet means being controlled by a pressure controlled solonoid valve; emergency gas outlet means from the upper reactors of said master control cylinder, flow of gas from said emergency gas outlet means being controlled by a rupturable valve, which is adapted to rupture at a designated pressure higher than that which actuated the solonoid valve of the primary gas outlet means; liquid outlet means from the lower reactors of the master control cylinder, flow of liquid through said liquid outlet means being controlled by a float valve; and emergency by-pass fluid outlet means near the lower reactors of said master control cylinder, flow of fluid through the fluid outlet means being controlled by a solonoid valve actuated by a combined liquid/gas pressure of which the liquid is insufficient to activate the float valve and the gas is insufficient to activate the primary gas outlet solonoid valve.

4. The improved heat exchange system of claim 1 wherein the hot water outlet means from the tank comprises a perforated tube extending across the upper extent of the tank.

5. The improved heat exchange system of claims 1, 2 or 3 including auxiliary electric heaters disposed in the upper region of the tank, and a thermostat for automatically operating such electrical heaters.

* * * * *